US012760460B2

(12) United States Patent
Lee et al.

(10) Patent No.: US 12,760,460 B2
(45) Date of Patent: Oct. 13, 2026

(54) WASHING MACHINE AND CONTROLLING METHOD SAME

(71) Applicant: SAMSUNG ELECTRONICS CO., LTD., Suwon-si (KR)

(72) Inventors: Jiyu Lee, Suwon-si (KR); Bongjin Ko, Suwon-si (KR); Younghyun Kim, Suwon-si (KR); Seulgi Lee, Suwon-si (KR); Hyounyoung Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 218 days.

(21) Appl. No.: 18/734,244

(22) Filed: Jun. 5, 2024

(65) Prior Publication Data

US 2024/0337058 A1 Oct. 10, 2024

Related U.S. Application Data

(63) Continuation of application No. PCT/KR2022/017109, filed on Nov. 3, 2022.

(30) Foreign Application Priority Data

Dec. 31, 2021 (KR) ..... 10-2021-0194570

(51) Int. Cl.
*D06F 33/34* (2020.01)
*D06F 33/37* (2020.01)
(Continued)

(52) U.S. Cl.
CPC ..... *D06F 33/34* (2020.02); *D06F 33/37* (2020.02); *D06F 33/42* (2020.02); *D06F 33/43* (2020.02); *D06F 34/22* (2020.02); *D06F 2103/18* (2020.02)

(58) Field of Classification Search
CPC ..... D06F 33/34; D06F 33/37; D06F 33/42; D06F 33/43; D06F 39/02; D06F 39/022;
(Continued)

(56) References Cited

U.S. PATENT DOCUMENTS 7,921,493 B2 4/2011 Kim et al.
10,526,738 B2 1/2020 Cho et al.
(Continued)

FOREIGN PATENT DOCUMENTS

JP 2017-158946 A 9/2017
JP 2021-007636 1/2021
(Continued)

OTHER PUBLICATIONS

Machine Translation of Choi, KR-20060004123-A, Jan. 2006. (Year: 2006).*
(Continued)

*Primary Examiner* — David G Cormier
(74) *Attorney, Agent, or Firm* — STAAS & HALSEY LLP

(57) ABSTRACT

A washing machine may include a tub; a detergent supply part to accommodate a liquid; a fluid channel connecting the detergent supply part and the tub; a motor controllable to supply the liquid accommodated in the detergent supply part into the tub through the fluid channel; a water supply part controllable to supply water into the tub; and a processor configured to: based on receiving a command for cleaning the fluid channel, identify a type of the liquid accommodated in the detergent supply part, based on the identified type of the liquid being water, control the water supply part to supply water into the tub, detect a level of water in the tub, and based on the detected level being greater than or equal to a predetermined value, control the motor so that the liquid
(Continued)

accommodated in the detergent supply part is supplied into the tub through the fluid channel.

14 Claims, 7 Drawing Sheets

(51) Int. Cl.

| | |
|---|---|
| ***D06F 33/42*** | (2020.01) |
| ***D06F 33/43*** | (2020.01) |
| ***D06F 34/22*** | (2020.01) |
| *D06F 103/18* | (2020.01) |

(58) Field of Classification Search
CPC ..... D06F 39/028; D06F 39/086; D06F 2103/18; D06F 2103/22; D06F 2105/42; D06F 2105/54
See application file for complete search history.

(56) References Cited

U.S. PATENT DOCUMENTS

| | | | |
|---|---|---|---|
| 11,299,837 | B2 | 4/2022 | Cho et al. |
| 11,335,340 | B2 | 5/2022 | Shin et al. |
| 2019/0106829 | A1 | 4/2019 | Bueno et al. |

FOREIGN PATENT DOCUMENTS

| | | | | | |
|---|---|---|---|---|---|
| JP | 2021-146140 | A | | 9/2021 | |
| KR | 10-1988-0011399 | A | | 10/1988 | |
| KR | 20-1990-0004286 | | | 5/1990 | |
| KR | 20060004123 | A | * | 1/2006 | ..... D06F 39/087 |
| KR | 10-2006-0093872 | A | | 8/2006 | |
| KR | 10-2007-0088212 | A | | 8/2007 | |
| KR | 10-1315425 | B1 | | 10/2013 | |
| KR | 10-2014-0019555 | A | | 2/2014 | |
| KR | 10-1611279 | B1 | | 4/2016 | |
| KR | 10-2020-0016642 | A | | 2/2020 | |
| KR | 10-2111673 | B1 | | 5/2020 | |
| KR | 10-2233307 | B1 | | 3/2021 | |

OTHER PUBLICATIONS

International Search Report of International Application No. PCT/KR2022/017109 dated Jan. 12, 2023.
Written Opinion of the International Searching Authority of International Application No. PCT/KR2022/017109 dated Jan. 12, 2023.
Extended European Search Report issued in counterpart European Application No. 22916371.2 dated Feb. 26, 2025.

* cited by examiner

WASHING MACHINE AND CONTROLLING METHOD SAME

CROSS-REFERENCE TO RELATED APPLICATION(S)

This application is a continuation application, claiming priority under § 365(c), of an International application No. PCT/KR2022/017109, filed on Nov. 3, 2022, which is based on and claims the benefit of a Korea patent application number 10-2021-0194570, filed on Dec. 31, 2021, in the Korean Intellectual Property Office, the disclosure of which is incorporated by reference herein in its entirety.

TECHNICAL FIELD

The disclosure relates to a washing machine and a method for controlling the same, and more particularly, to a washing machine that can wash laundry through a detergent and a fabric softener, etc., and a method for controlling the same.

BACKGROUND ART

In general, a washing machine means a device that includes a washing tub wherein a specific amount of water is contained, and a drum that is rotatably installed inside the washing tub. The washing machine performs washing of laundry by rotating the drum containing the laundry, and discharges water inside the washing machine to the outside when washing is completed.

Unless a user cleans the inside of a detergent supply part separately after performing washing, the detergent and the fabric softener that were used in the previous washing cycle may remain in a fluid channel connecting the detergent supply part and the washing tub.

Accordingly, when the user inputs a detergent and a fabric softener for performing the next washing, a phenomenon wherein the previous detergent and fabric softener remaining in the fluid channel connecting the detergent supply part and the washing tub are mixed may occur, and if this is neglected for a long time, a problem that mold, etc. are generated due to the remaining detergent and fabric softener may occur.

Accordingly, it is required to search for a method which enables easy cleaning of a detergent and a fabric softener remaining in a fluid channel connecting a detergent supply part and a washing tub.

DISCLOSURE

Technical Solution

The disclosure was devised according to the aforementioned need, and the purpose of the disclosure is in providing a washing machine that can clean a detergent and a fabric softener remaining in a fluid channel connecting a detergent supply part and a washing tub, and a method for controlling the same.

A washing machine according to an embodiment of the disclosure includes a washing tub, a detergent supply part to accommodate a liquid, a fluid channel connecting the detergent supply part and the washing tub, a motor controllable to supply the liquid accommodated in the detergent supply part into the washing tub through the fluid channel, a water supply part controllable to supply water into the washing tub, and a processor configured to: based on receiving a user command for cleaning the fluid channel, identify a type of the liquid accommodated in the detergent supply part, based on identified type of the liquid being water, control the water supply part to supply water into the washing tub, after water is supplied into the washing tub, detect a level of water in the washing tub, and based on the detected level being greater than or equal to a predetermined value, control the motor so that the liquid accommodated in the detergent supply part is supplied into the washing tub through the fluid channel.

Here, the detergent supply part may include a detergent container, and a fabric softener container, the motor may include a first motor controllable to supply a liquid accommodated in the detergent container into the washing tub through the fluid channel, and a second motor controllable to supply a liquid accommodated in the fabric softener container into the washing tub through the fluid channel, and the processor may be further configured to: based on identifying that the liquid accommodated in each of the detergent container is water, and the liquid accommodated in the fabric softener container is water, control the water supply part to supply water into the washing tub, and after water is supplied into the washing tub, detect a level of water in the washing tub, and based on the detected level being greater than or equal to the predetermined value, control the first motor so that the liquid accommodated in the detergent container is supplied into the washing tub through the fluid channel, and control the second motor so that the liquid accommodated in the fabric softener container is supplied into the washing tub through the fluid channel.

Here, the processor may be further configured to: based on the detected level being greater than or equal to the predetermined value, control the first motor so that the liquid accommodated in the detergent container is supplied into the washing tub through the fluid channel during a predetermined first time, based on the predetermined first time passing, stop the first motor, and control the second motor so that the liquid accommodated in the fabric softener container is supplied into the washing tub through the fluid channel during a predetermined second time, and based on the predetermined second time passing, stop the second motor.

Here, the processor may be further configured to: based on a predetermined third time passing after the second motor is stopped, repeatedly control during a predetermined fourth time: the first motor so that the liquid accommodated in the detergent container is supplied into the washing tub through the fluid channel then stopped, and the second motor so that the liquid accommodated in the fabric softener container is supplied into the washing tub through the fluid channel then stopped.

Also, the washing machine may further include a drainage pump connected to the washing tub and controllable to discharge liquid accommodated in the washing tub to an outside of the washing machine, and the processor may be further configured to: based on the liquid accommodated in the detergent supply part being supplied into the washing tub through the fluid channel, control the drainage pump to discharge the liquid accommodated in the washing tub to the outside of the washing machine.

In addition, the washing machine may further include a door to open and close the washing tub, and the processor may be further configured to: based on receiving the user command, identify whether the door is closed, and based on identifying that the door is closed, identify the type of the liquid accommodated in the detergent supply part.

Further, the processor may be further configured to: based on receiving the user command, identify whether the detergent supply part is coupled to the washing machine, and based on identifying that the detergent supply part is coupled, identify the type of the liquid accommodated in the detergent supply part.

Still further, the washing machine may further include: a sensor configured to output a value corresponding to the type of liquid accommodated in the detergent supply part, and the processor may be further configured to: identify the type of the liquid accommodated in the detergent supply part based on the value.

A controlling method of a washing machine having a washing tub, a detergent supply part to accommodate a liquid, a fluid channel connecting the detergent supply part and the washing tub, a motor controllable to supply the liquid accommodated in the detergent supply part into the washing tub through the fluid channel, a water supply part controllable to supply water into the washing tub, and a processor, according to an embodiment of the disclosure may include: by the process, based on receiving a user command for cleaning the fluid channel, identifying a type of the liquid accommodated in the detergent supply part, based on the identified type of the liquid being water, controlling the water supply part to supply water into the washing tub, detecting a level of water in the washing tub, and based on the detected level being greater than or equal to a predetermined value, controlling the motor so that the liquid accommodated in the detergent supply part is supplied into the washing tub through the fluid channel.

Here, the detergent supply part may include a detergent container and a fabric softener container, and the motor may include: a first motor controllable to supply a liquid accommodated in the detergent container into the washing tub through the fluid channel, and a second motor controllable to supply a liquid accommodated in the fabric softener container into the washing tub through the fluid channel, and the controlling the motor may further include: controlling the first motor so that the liquid accommodated in the detergent container is supplied into the washing tub through the fluid channel, and then controlling the second motor so that the liquid accommodated in the fabric softener container is supplied into the washing tub through the fluid channel.

Here, the controlling the motor may further include: based on the detected level being greater than or equal to the predetermined value, controlling the first motor so that the liquid accommodated in the detergent container is supplied into the washing tub through the fluid channel during a predetermined first time, based on the predetermined first time passing, stopping the first motor, and controlling the second motor so that the liquid accommodated in the fabric softener container is supplied into the washing tub through the fluid channel during a predetermined second time, and based on the predetermined second time passing, stopping the second motor.

Here, the controlling the motor may further include: based on a predetermined third time passing after stopping the second motor, repeatedly controlling during a predetermined fourth time: the first motor so that the liquid accommodated in the detergent container is supplied into the washing tub through the fluid channel, then stopping the first motor, and the second motor so that the liquid accommodated in the fabric softener container is supplied into the washing tub through the fluid channel, then stopping the second motor.

Also, the washing machine may further include a drainage pump connected to the washing tub and controllable to discharge liquid accommodated in the washing tub to the outside of the washing machine, and the controlling method may further include: based on the liquid accommodated in the detergent supply part being supplied into the washing tub through the fluid channel, controlling the drainage pump to discharge the liquid accommodated in the washing tub to the outside of the washing machine.

In addition, the washing machine may further include a door to open and close the washing tub, and the controlling method may further include: based on receiving the user command, identifying whether the door is closed, and the identifying the type of the liquid accommodated in the detergent supply part further includes: based on identifying that the door is closed, identifying the type of the liquid accommodated in the detergent supply part.

Further, the controlling method may further include: based on receiving the user command, identifying whether the detergent supply part is coupled to the washing machine, and the identifying the type of the liquid accommodated in the detergent supply part further includes: based on identifying that the detergent supply part is coupled, identifying the type of the liquid accommodated in the detergent supply part.

According to the various embodiments of the disclosure, a user can easily clean a fluid channel connecting a detergent supply part and a washing tub by using a cleaning mode of a washing machine, and can thereby remove a detergent and a fabric softener remaining inside the fluid channel connecting the detergent supply part and the washing tub, and maintain the fluid channel clean.

MODE FOR INVENTION

Figure 1:
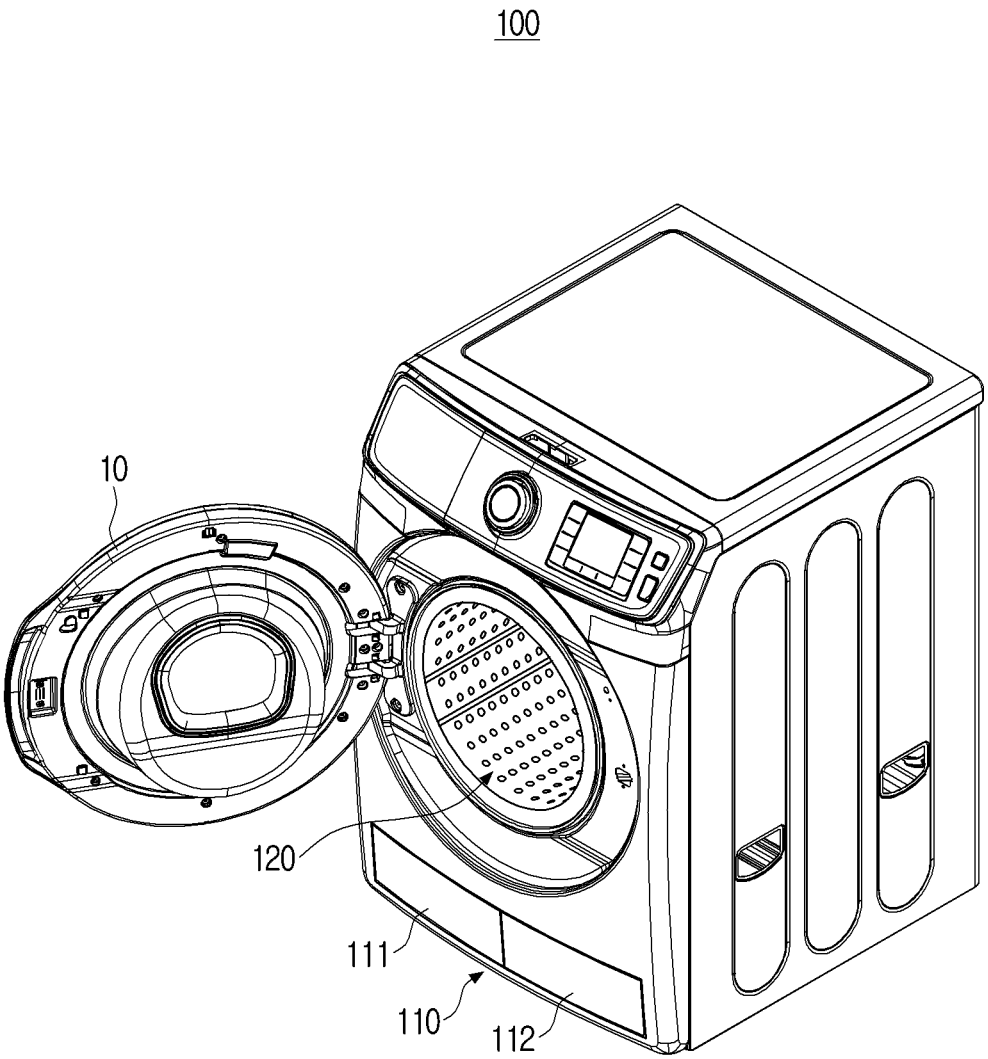
FIG. 1 is a diagram illustrating a washing machine according to an embodiment of the disclosure.

Hereinafter, various embodiments of the disclosure will be described with reference to the accompanying drawings. However, it should be noted that the various embodiments are not for limiting the technology described in the disclosure to a specific embodiment, but they should be interpreted to include various modifications, equivalents, and/or alternatives of the embodiments of the disclosure. Also, with reference to the detailed description of the drawings, similar components may be designated by similar reference numerals.

In the disclosure, expressions such as "have," "may have," "include," and "may include" denote the existence of such characteristics (e.g.: elements such as numerical values, functions, operations, and components, etc.), and the expressions do not exclude the existence of additional characteristics.

In addition, in the disclosure, the expressions "A or B," "at least one of A and/or B," or "one or more of A and/or B" and the like may include all possible combinations of the listed items. For example, "A or B," "at least one of A and B," or "at least one of A or B" may refer to all of the following cases: (1) including at least one A, (2) including at least one B, or (3) including at least one A and at least one B.

Further, the expressions "first," "second," and the like used in the disclosure may be used to describe various elements regardless of any order and/or degree of importance. In addition, such expressions are used only to distinguish one element from another element, and are not intended to limit the elements.

Also, the description in the disclosure that one element (e.g.: a first element) is "(operatively or communicatively) coupled with/to" or "connected to" another element (e.g.: a second element) should be interpreted to include both the case where the one element is directly coupled to the another element, and the case where the one element is coupled to the another element through still another element (e.g.: a third element). In contrast, the description that one element (e.g.: a first element) is "directly coupled" or "directly connected" to another element (e.g.: a second element) can be interpreted to mean that still another element (e.g.: a third element) does not exist between the one element and the another element.

In addition, the expression "configured to" used in the disclosure may be interchangeably used with other expressions such as "suitable for," "having the capacity to," "designed to," "adapted to," "made to," and "capable of," depending on cases. Meanwhile, the term "configured to" may not necessarily mean that a device is "specifically designed to" in terms of hardware. Instead, under some circumstances, the expression "a device configured to" may mean that the device "is capable of" performing an operation together with another device or component. For example, the phrase "a processor configured to perform A, B, and C" may mean a dedicated processor (e.g.: an embedded processor) for performing the corresponding operations, or a generic-purpose processor (e.g.: a CPU or an application processor) that can perform the corresponding operations by executing one or more software programs stored in a memory device.

FIG. 1 is a diagram illustrating a washing machine according to an embodiment of the disclosure.

Referring to FIG. 1, the washing machine 100 may mean a device that washes laundry by using water and a detergent, etc., and performs spin drying for the wet laundry. Also, depending on embodiments, the washing machine 100 may perform drying for the laundry for which spin drying was completed.

A user may input a detergent and a fabric softener into the washing machine 100 for washing of laundry, and then input a washing command through an input device (not shown) such as a touch screen, etc. provided on the washing machine 100. Accordingly, the washing machine 100 may perform a washing cycle by using the detergent and the fabric softener that the user inputted, and water supplied from a water supply part provided separately.

However, unless the user cleans the inside of the detergent supply part separately after performing washing, the detergent and the fabric softener that were used in the previous washing cycle may remain in a fluid channel connecting the detergent supply part and the washing tub.

Accordingly, when the user inputted a detergent and a fabric softener for performing the next washing, a phenomenon wherein the previous detergent and fabric softener remaining in the fluid channel connecting the detergent supply part and the washing tub are mixed may occur, and if this is neglected for a long time, a problem that mold, etc. are generated due to the remaining detergent and fabric softener may occur.

Meanwhile, according to an embodiment of the disclosure, the user may remove the detergent and the fabric softener remaining inside the fluid channel connecting the detergent supply part 110 and the washing tub 120, and maintain the fluid channel clean by inputting water into the detergent container 111 and the fabric softener container 112, and operating a mode of cleaning the fluid channel connecting the detergent supply part 110 and the washing tub 120, and detailed explanation in this regard will be described below.

Figure 2:
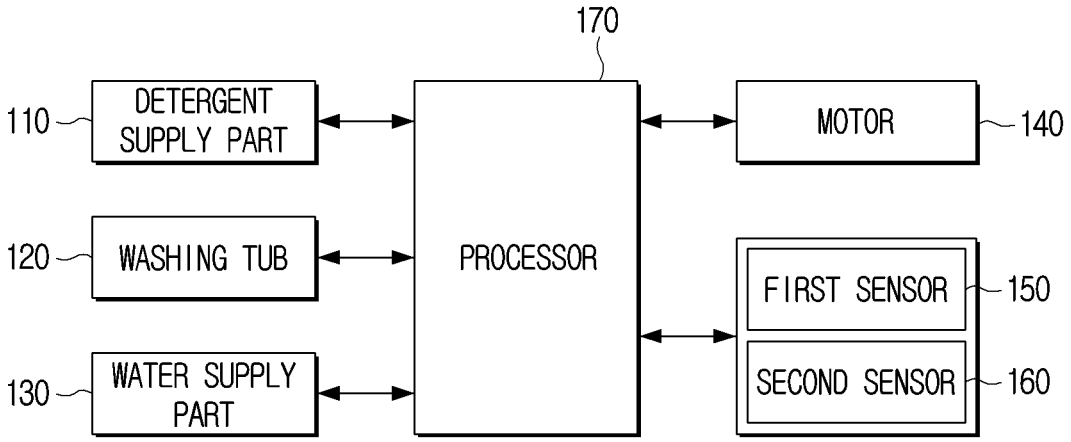
FIG. 2 is a block diagram for illustrating a configuration of a washing machine according to an embodiment of the disclosure.

FIG. 2 is a block diagram for illustrating a configuration of a washing machine according to an embodiment of the disclosure.

Referring to FIG. 2, the washing machine 100 may include a detergent supply part 110, a washing tub 120, a water supply part 130, a motor 140, a first sensor 150, a second sensor 160, and a processor 170.

The detergent supply part 110 is a component for supplying a detergent and a fabric softener necessary for washing of laundry, and may include a detergent container 111 and a fabric softener container 112.

In case the user inputted a detergent and a fabric softener respectively into the detergent container 111 and the fabric softener container 112 and executed a washing function, the detergent and the fabric softener may respectively be supplied into the washing tub 120 through an automatic detergent input device (not shown) provided in the detergent supply part 110.

Here, the automatic detergent input device (not shown) provided in the detergent supply part 110 is a device for automatically supplying liquids accommodated in the detergent container 111 and the fabric softener container 112 into the washing tub 120 on a predetermined time according to the washing mode during a washing cycle. For this, the automatic detergent input device (not shown) may include a pump (not shown) that can circulate a liquid accommodated in the detergent supply part 110 by using mechanical energy generated by an operation of the motor 140.

The washing tub 120 may be installed on the inner side of the washing machine 100, and may be formed as a cylindrical shape on which an opening is provided toward the laundry inlet. In the washing tub 120, a predetermined amount of water necessary for washing and a detergent supplied from the detergent supply part 110 may be accommodated together.

A drum formed inside the washing tub 120 may form a space wherein input laundry is washed. The drum may be provided with a plurality of through holes through which water can pass, and the water in the washing tub 120 may be introduced to the inside of the drum through them, and the water inside the drum may be discharged to the washing tub 120. The drum may be rotated by a driving motor provided in the washing machine 100, and as the drum rotates, the laundry may be rubbed with the water stored in the washing tub 120, and washing may be performed through this.

The water supply part 130 is a component for supplying water into the inside of the washing tub 120. The water supply part 130 may include a water supply pipe connected with an external water supply source such as a water tap, etc. and a water supply valve opening or closing the water supply pipe.

The motor 140 may be provided on the inside of the detergent supply part 110, and may be used in driving of the automatic detergent input device. That is, the motor 140 may be driven for supplying a liquid accommodated in the detergent supply part 110 into the washing tub 120 along the fluid channel connecting the detergent supply part 110 and the washing tub 120 when the washing machine 100 operates. Specifically, the motor 140 may provide mechanical energy necessary for a pumping operation of supplying the liquid accommodated in the detergent supply part 110 into the washing tub 120 to the automatic detergent input device, and accordingly, the liquid accommodated in the detergent supply part 110 may be supplied into the washing tub 120.

The motor 140 may include a first motor supplying a liquid accommodated in the detergent container 111 into the washing tub 120 along the fluid channel, and a second motor supplying a liquid accommodated in the fabric softener container 112 into the washing tub 120 along the fluid channel.

Here, the fluid channel may mean all routes that are formed between the detergent supply part 110 and the washing tub 120, and are passed when a liquid accommodated in the detergent supply part 110 is supplied into the washing tub 120.

Figure 3:
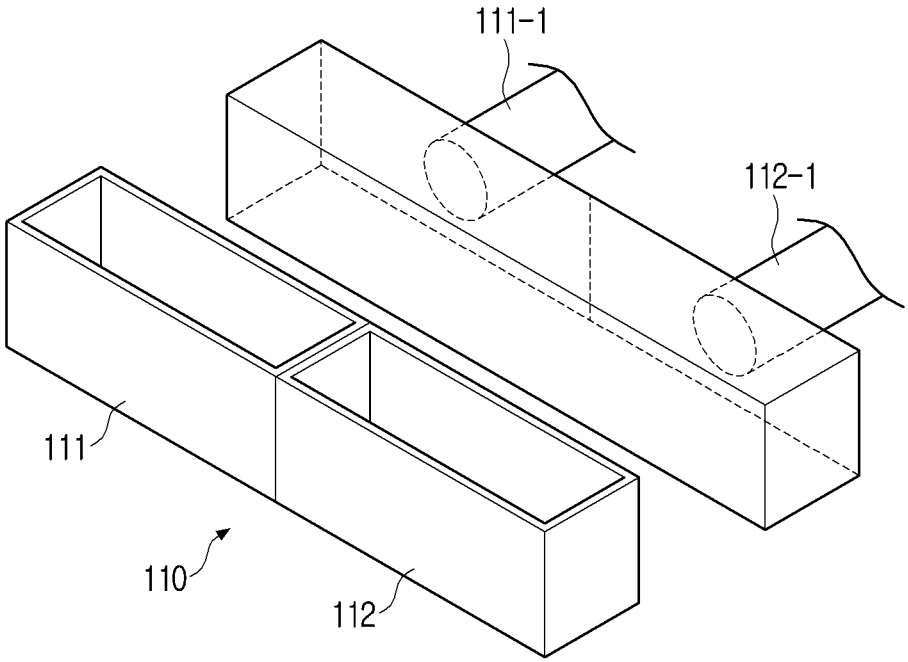
FIG. 3 is a diagram for illustrating a detailed configuration of a detergent supply part according to an embodiment of the disclosure.

That is, referring to FIG. 3, the liquids accommodated in the detergent container 111 and the fabric softener container 112 of the detergent supply part 110 respectively pass via a detergent pipe 111-1 and a fabric softener pipe 112-1 to be input into the washing tub 120, and here, the detergent pipe 111-1 and the fabric softener pipe 112-1 may be included in the fluid channel.

Figure 4:
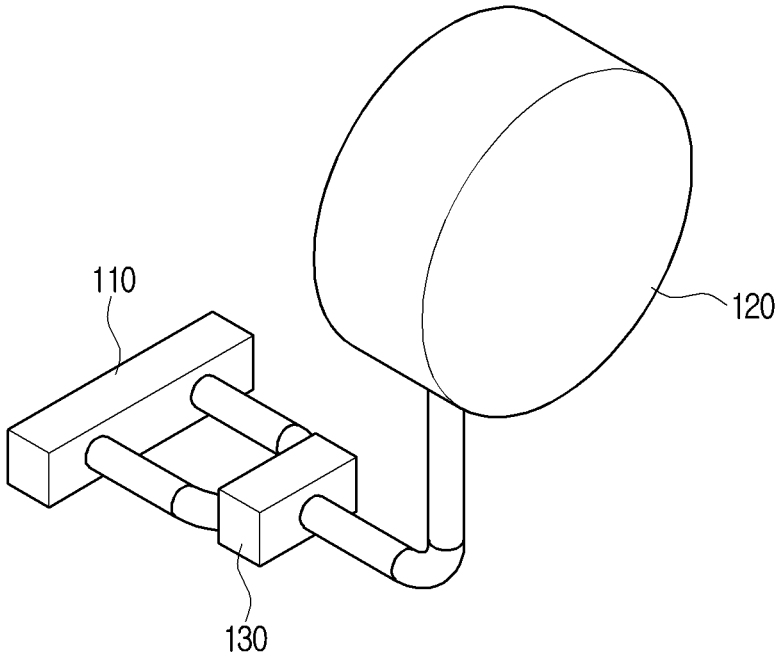
FIG. 4 is a diagram for illustrating a fluid channel connecting a detergent supply part and a washing tub according to an embodiment of the disclosure.

Also, referring to FIG. 4, when the liquid accommodated in the detergent supply part 110 is supplied into the washing tub 120 by a pumping operation due to driving of the motor 140 after passing through the pipe, the liquid passes via the automatic detergent input device including the motor 140, and here, the automatic detergent input device including the motor 140 may also be included in the fluid channel.

The first sensor 150 is a component for detecting the type of the liquid accommodated in the detergent supply part 110, and may be provided on the inside of the detergent supply part 110. Specifically, the first sensor 150 may make an electric current flow in the liquid accommodated in the detergent supply part 110 and measure a resistance value, and transmit the measured resistance value to the processor 170.

In this case, the processor 170 may identify the type of the liquid accommodated in the detergent supply part 110 based on the resistance value of the liquid received from the first sensor 150. Specifically, the processor 170 may identify which of a detergent, a fabric softener, or water the type of the liquid accommodated in the detergent supply part 110 is based on the resistance value of the liquid received from the first sensor 150.

That is, according to whether the type of the liquid accommodated in the detergent supply part 110 is a detergent, a fabric softener, or water, the resistance values detected at the first sensor 150 may be different from one another. Accordingly, the processor 170 may identify whether the liquid accommodated in the detergent supply part 110 is a detergent, a fabric softener, or water by using a prestored database including information on types of liquids indicated by resistance values for each resistance value, and a resistance value detected at the first sensor 150.

The second sensor 160 is a component for detecting a water level of the washing tub 120, and may be provided on the inner side of the washing tub 120. The second sensor 160 may detect a water level of the washing tub 120, and transmit the detected water level value of the washing tub 120 to the processor 170.

The processor 170 may control overall operations of the washing machine 100. For example, the processor 170 may control operations of each hardware provided in the washing machine 100, and support various kinds of functions by executing an operating system (O/S) stored in a memory provided in the washing machine 100 or various kinds of applications.

In particular, the processor 170 may perform an operation for cleaning the fluid channel connecting the detergent supply part and the washing tub, and more detailed explanation in this regard will be described with reference to the attached FIG. 5 below.

First, the processor 170 may receive a user command for cleaning the fluid channel in operation S510. For this, the washing machine 100 according to an embodiment of the disclosure may display a UI displaying a mode wherein the fluid channel can be cleaned to the user, and the user may select the UI and input a user command for cleaning the fluid channel.

Accordingly, when a user command for cleaning the fluid channel is input, the processor 170 may operate in a cleaning mode wherein the fluid channel can be cleaned.

In this case, if a user command for cleaning the fluid channel is input in operation S510-Y, the processor 170 may identify the type of the liquid existing in the detergent supply part 110 based on a sensing value detected through the first sensor 150.

Specifically, the processor 170 may identify whether the type of the liquid accommodated in the detergent supply part 110 is a detergent, a fabric softener, or water according to the prestored database, based on the resistance value of the liquid received from the first sensor 150.

Then, if it is identified that the liquid accommodated in the detergent supply part 110 is water in operation S520-Y, the processor 170 may control the water supply part 130 to supply water into the washing tub 120.

That is, if it is identified that the liquids accommodated in each of the detergent container 111 and the fabric softener container 112 are water, the processor 170 may supply water to the washing tub 120.

Specifically, the processor 170 may supply water to the washing tub 120 by controlling the water supply part 130 such that the water supply vale opening or closing the water supply pipe connected with an external water supply source is opened. Through this, when the cleaning mode is operated, the detergent and the fabric softener remaining in the fluid channel may be removed as the water accommodated in the detergent supply part 110 is supplied into the washing tub 120 along the fluid channel connecting the detergent supply part 110 and the washing tub 120. In this case, the water accommodated in the detergent supply part 110 is mixed with the detergent and the fabric softener remaining in the fluid channel, and for discharging this smoothly, the processor 170 may supply a specific amount of water into the washing tub 120 in advance.

Afterwards, if the water level of the washing tub 120 detected through the second sensor 160 after water was supplied into the washing tub 120 is greater than or equal to a predetermined value in operation S540-Y, the processor 170 may drive the motor 140 such that the water accommodated in the detergent supply part 110 is supplied into the washing tub 120 along the fluid channel in operation S550.

That is, the processor 170 may identify the water level of the washing tub 120 detected through the second sensor 160, and in case the water level of the washing tub 120 did not reach the predetermined value, the processor 170 may keep controlling the water supply part 130 to supply water into the washing tub 120. Then, in case the water level of the washing tub 120 is greater than or equal to the predetermined value, the processor 170 may stop the water supplying operation through the water supply part 130 by closing the water supply value, and drive the motor 140 afterwards such that the water accommodated in the detergent supply part 110 is supplied into the washing tub 120 along the fluid channel.

Here, in case the water level of the washing tub 120 detected through the second sensor 160 after water was supplied into the washing tub 120 is greater than or equal to the predetermined value, the processor 170 may drive the first motor and the second motor such that the water accommodated in each of the detergent container 111 and the fabric softener container 112 is supplied into the washing tub 120 along the fluid channel.

That is, as described above, the motor 140 includes a first motor and a second motor, and the processor 170 may drive the first motor and the second motor to supply the water accommodated in each of the detergent container 111 and the fabric softener container 112 included in the detergent supply part 110 into the washing tub 120.

Here, in case the water level of the washing tub 120 detected through the second sensor 160 after water was supplied into the washing tub 120 is greater than or equal to the predetermined value, the processor 170 may drive the first motor during a predetermined first time, and stop the driving of the first motor after the predetermined first time passes, and drive the second motor during a predetermined second time, and stop the driving of the second motor after the predetermined second time passes.

For example, the processor 170 may operate the first motor during ten seconds to supply the water accommodated in the detergent container 111 into the washing tub 120, and stop the driving of the first motor after ten seconds pass, and operate the second motor during ten seconds to supply the water accommodated in the fabric softener container 112 into the washing tub 120, and then stop the driving of the second motor after ten seconds pass again.

However, this is merely an example, and the time of driving the first and second motors may be various time sections such as 5 seconds, 20 seconds, 30 seconds, etc.

Here, if a predetermined third time passes after the driving of the second motor is stopped, the processor 170 may repeatedly perform driving and pause of the first motor and the second motor during a predetermined fourth time.

That is, the processor 170 may thereby prevent overheating of the motor 140 by stopping the driving of the motor 140 during the predetermined third time after the driving of the second motor is stopped.

For example, the processor 170 may stop the driving of the first motor and the second motor during ten seconds after the driving of the second motor is stopped. Afterwards, the processor 170 may repeatedly perform the process of driving and stopping the first motor and the second motor described above during five minutes.

However, this is merely an example, and the time of stopping the driving of the motor 140 may be various time sections such as 5 seconds, 20 seconds, 30 seconds, etc., and the time of repeatedly performing the process of driving and stopping the first motor and the second motor may be various time sections such as 3 minutes, 10 minutes, etc.

From below, a process wherein water accommodated in the detergent supply part 110 is mixed with the remaining detergent and fabric softener in a process of moving to the washing tub 120 through the fluid channel, and is then discharged to the outside will be described.

For discharging the water mixed with the detergent and the fabric softener remaining in the fluid channel to the outside after finishing a cleaning operation of the fluid channel, the washing machine 100 according to an embodiment of the disclosure may further include a drainage pump 180.

Then, if the water accommodated in the detergent supply part 110 is supplied into the washing tub 120 along the fluid channel, the processor 170 may drive the drainage pump 180 and discharge the liquid accommodated in the washing tub 120 to the outside of the washing machine 100.

Here, the drainage pump 180 is a component for discharging the water accommodated in the washing tub 120 to the outside of the washing machine 100 during rinsing and spin drying cycles performed after the washing cycle. For this, the drainage pump 180 may be provided with a motor (not shown), and apply mechanical energy to the liquid accommodated in the washing tub 120, and discharge the liquid to the outside of the washing machine 100.

Meanwhile, the washing machine 100 according to an embodiment of the disclosure may be provided with a third sensor (not shown) that detects opening and closing of the door 10 that opens or closes the washing tub 120. In case the function of cleaning the fluid channel is operated while the door 10 is opened, the water accommodated in the washing tub 120 may be discharged to the outside through the door 10. Accordingly, if it is identified that the door 10 is closed based on a sensing value detected through the third sensor (not shown), the processor 170 may operate the cleaning mode.

That is, if a user command for cleaning the fluid channel is input, the processor 170 may identify whether the door 10 is in a closed state based on a sensing value detected through the third sensor 190, and if it is identified that the door 10 is closed, the processor 170 may identify the type of the liquid existing in the detergent supply part 110.

Also, the washing machine 100 according to an embodiment of the disclosure may be provided with a fourth sensor (not shown) for detecting whether the detergent supply part 110 is coupled. In case the function of cleaning the fluid channel is operated while the detergent supply part 110 is not coupled to the washing machine 100, the liquid accommodated in the detergent supply part 110 cannot be supplied into the washing tub 120 properly, and thus the processor 170 may operate the cleaning mode if it is identified that the detergent supply part 110 is coupled to the washing machine 100 based on a sensing value detected through the fourth sensor (not shown).

That is, if a user command for cleaning the fluid channel is input, the processor 170 may identify whether the detergent supply part 110 is in a coupled state to the washing machine 100 based on a sensing value detected through the fourth sensor (not shown), and if it is identified that the detergent supply part 110 is coupled, the processor 170 may identify the type of the liquid existing in the detergent supply part 110.

By the process as described above, the user can clean the detergent and the fabric softener remaining in the fluid channel connecting the detergent supply part 110 and the washing tub 120 by supplying water to the detergent container 111 and the fabric softener container 112 included in the detergent supply part 110 and operating the cleaning mode.

Figure 6:
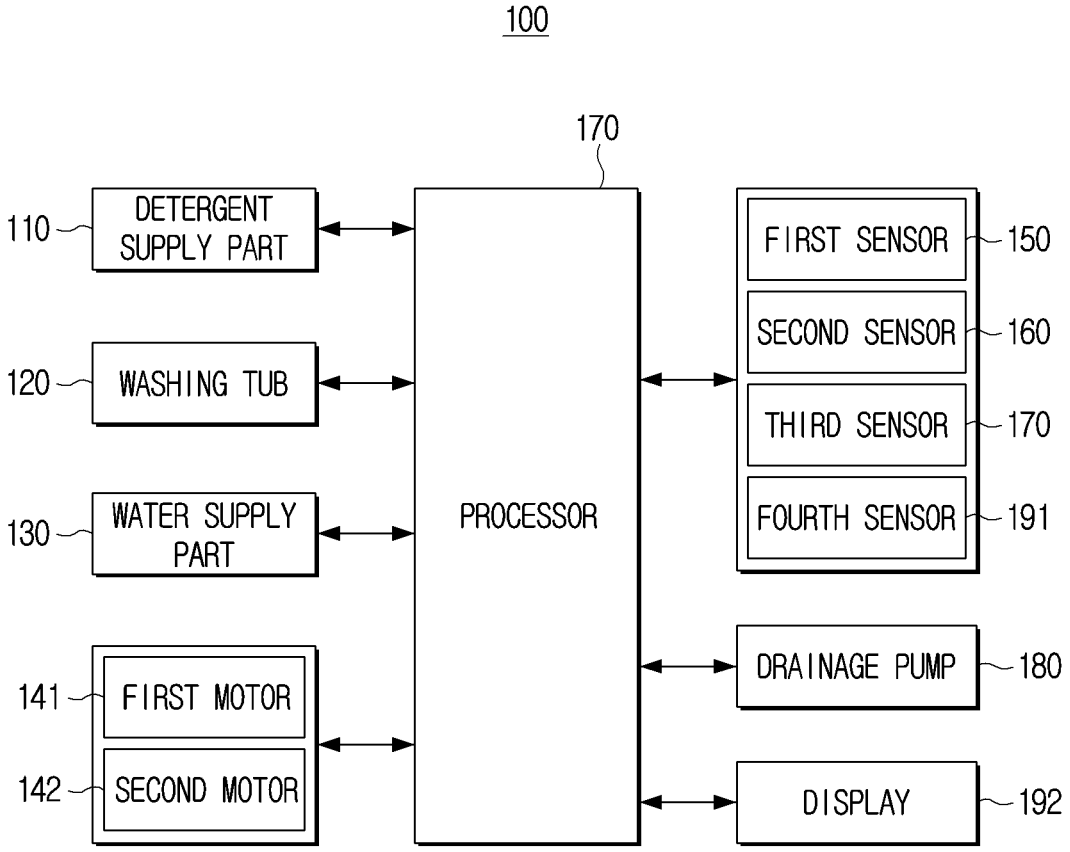
FIG. 6 is a block diagram for illustrating a detailed configuration of a washing machine according to an embodiment of the disclosure.

FIG. 6 is a block diagram for illustrating a detailed configuration of a washing machine according to an embodiment of the disclosure.

Referring to FIG. 6, the washing machine 100 may further include a third sensor 190, a fourth sensor 191, and a display 192 other than the detergent supply part 110, the washing tub 120, the water supply part 130, the motor 140, the first sensor 150, the second sensor 160, the processor 170, and the drainage pump 180.

Figure 5:
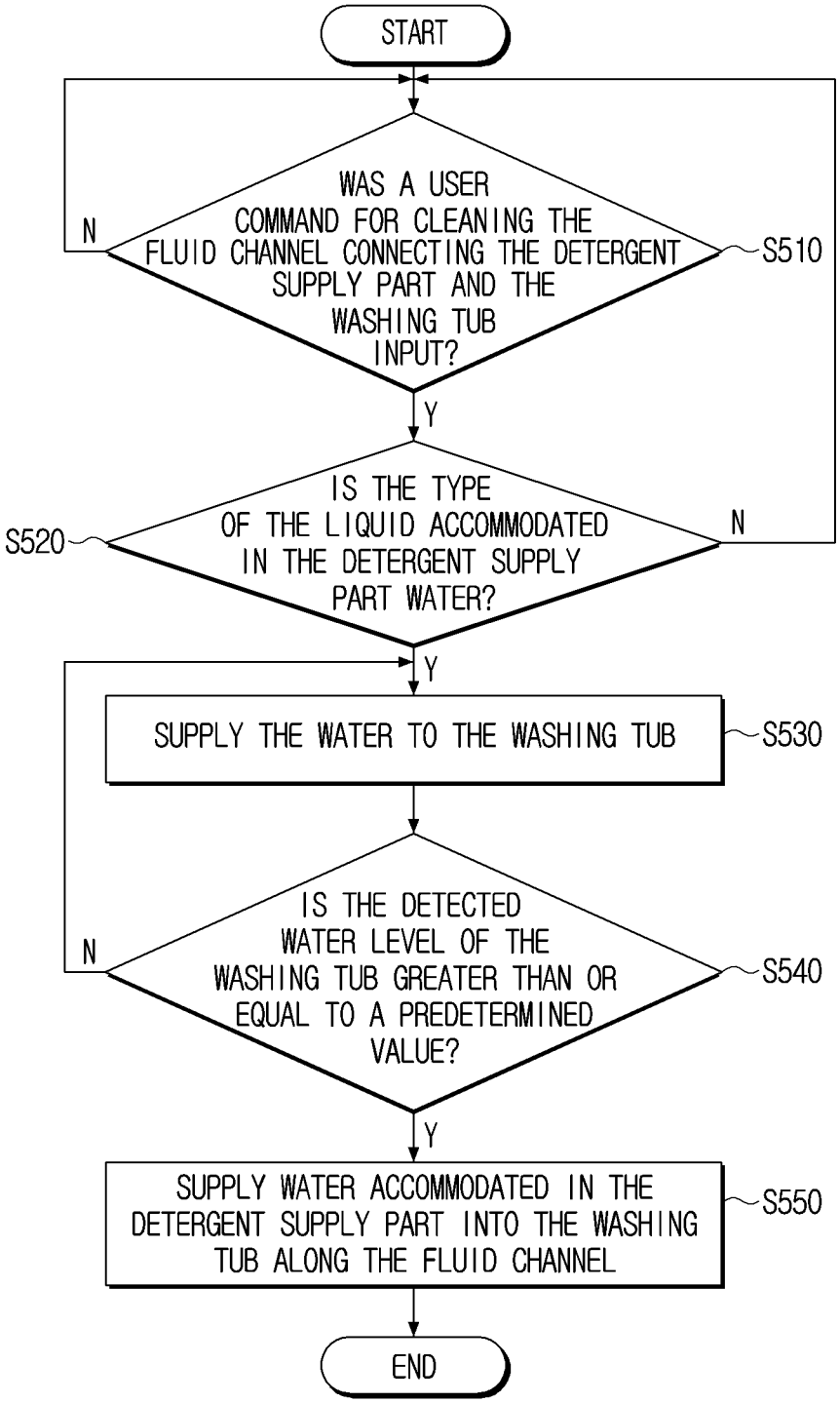
FIG. 5 is a flow chart for illustrating a method for cleaning a fluid channel of a washing machine according to an embodiment of the disclosure.

Meanwhile, the components illustrated in FIG. 5 are merely an example, and at least some components can obviously be omitted depending on embodiments.

Meanwhile, as the detergent supply part 110, the washing tub 120, the water supply part 130, the motor 140, the first sensor 150, the second sensor 160, the processor 170, the drainage pump 180, the third sensor 190, and the fourth sensor 191 were described above, overlapping explanation will be omitted.

As described above, the motor 140 may include a first motor 141 for supplying a liquid accommodated in the detergent container 111 into the washing tub 120, and a second motor 142 for supplying a liquid accommodated in the fabric softener container 112 into the washing tub 120.

The display 192 may display various screens. Specially, the display 192 may display information related to the washing machine 100 and information related to a washing cycle, etc. Also, the display 192 may display a screen recommending cleaning of the fluid channel of the washing machine 100 to the user, or display a screen notifying that the cleaning mode cannot be operated in case the liquid accommodated in the detergent supply part 110 is not water, etc.

In this case, the display 192 may be implemented as displays in various forms such as an LCD display, an LED display, etc., and may also be implemented as a touch screen for receiving an input of the user's touch.

Figure 7:
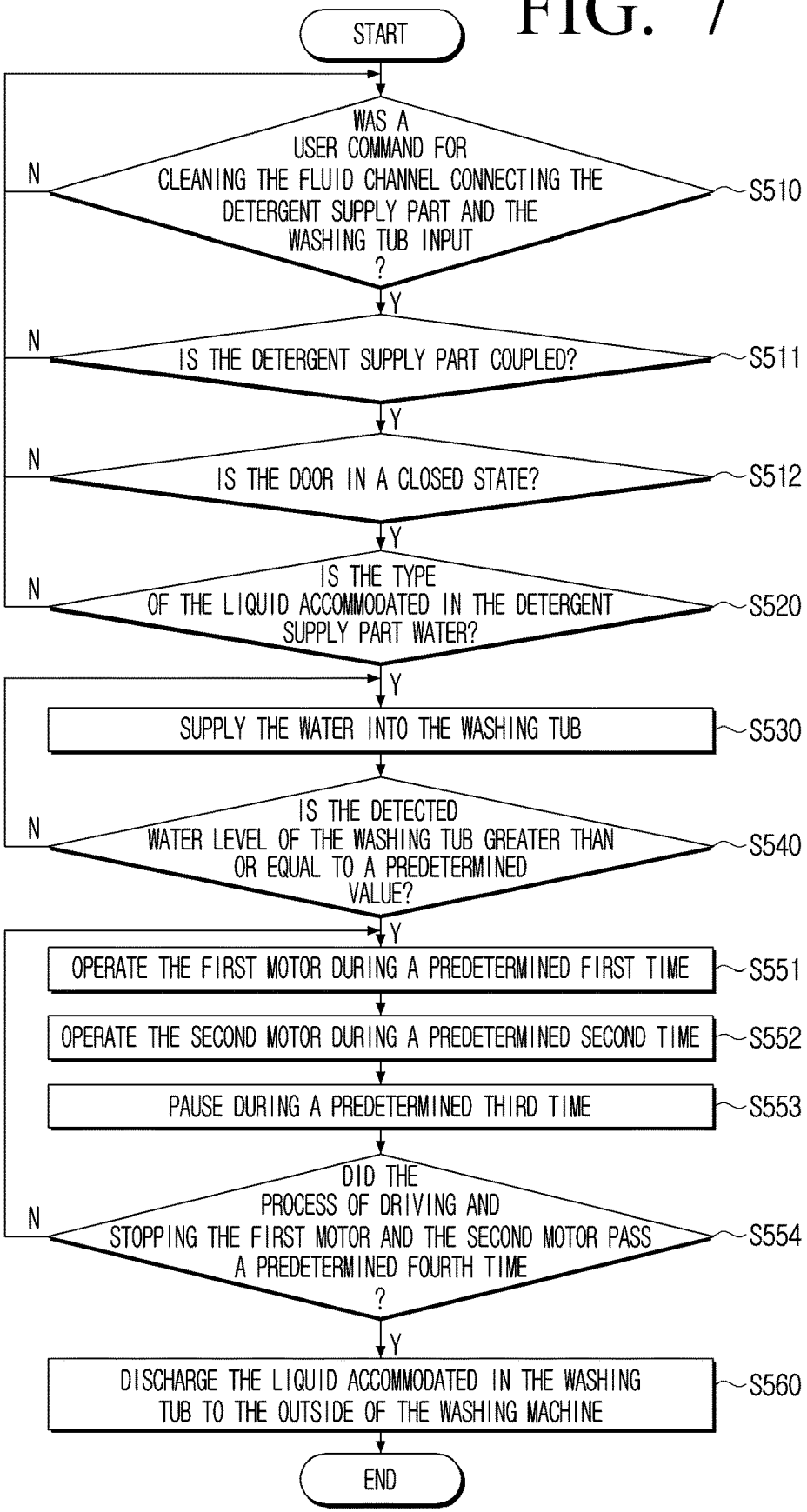
FIG. 7 is a flow chart for illustrating detailed steps of a method for cleaning a fluid channel of a washing machine in detail according to an embodiment of the disclosure.

FIG. 7 is a flow chart for illustrating detailed steps of a method for cleaning a fluid channel of a washing machine in detail according to an embodiment of the disclosure.

Summing up the aforementioned steps, first, it is identified whether a user command for cleaning the fluid channel connecting the detergent supply part and the washing tub was input in operation S510.

Afterwards, if it is identified that a user command for cleaning the fluid channel was input in operation S510-Y, it is identified whether the detergent supply part is coupled in operation S511.

If it is identified that the detergent supply part is coupled in operation S511-Y, it is identified whether the door is in a closed state in operation S512.

If it is identified that the door is closed in operation S512-Y, the type of the liquid accommodated in the detergent supply part is identified in operation S520.

Then, if it is identified that the liquid accommodated in the detergent supply part is water in operation S520-Y, the water is supplied into the washing tub in operation S530.

Afterwards, the water level of the washing tub is detected in operation S540.

In case the detected water level of the washing tub is greater than or equal to a predetermined value in operation S540-Y, the first motor is operated during a predetermined first time, and water accommodated in the detergent container is supplied into the washing tub in operation S551.

Afterwards, the operation of the first motor is stopped, and the second motor is operated during a predetermined second time, and water accommodated in the fabric softener container is supplied into the washing tub in operation S552.

Then, the operations of the first motor and the second motor are stopped, and the motor is maintained in a pause state during a predetermined third time in operation S553.

Afterwards, it is identified whether the process of repeating the driving and the pause of the first motor and the second motor passed a predetermined fourth time in operation S554.

If it is identified that the process of repeating the driving and the pause of the first motor and the second motor passed the predetermined fourth time in operation S554-Y, the liquid accommodated in the washing tub is discharged to the outside of the washing machine in operation S560.

As described above, the water accommodated in the detergent supply part 110 is supplied into the washing tub 120 through the fluid channel, and accordingly, the detergent and the fabric softener remaining in the fluid channel can be removed. Accordingly, a phenomenon wherein the detergent and the fabric softener that were input for using the washing machine 100 are mixed with the detergent and the fabric softener used in the previous washing cycle can be prevented, and a problem that mold, etc. are generated due to the detergent and the fabric softener remaining in the fluid channel can be resolved.

Meanwhile, according to an embodiment of the disclosure, the various embodiments described above may be implemented as software including instructions stored in machine-readable storage media, which can be read by machines (e.g.: computers). The machines refer to devices that call instructions stored in a storage medium, and can operate according to the called instructions, and the devices may include the device according to the aforementioned embodiments. In case an instruction is executed by a processor, the processor may perform a function corresponding to the instruction by itself, or by using other components under its control. An instruction may include a code that is generated or executed by a compiler or an interpreter. A storage medium that is readable by machines may be provided in the form of a non-transitory storage medium. Here, the term 'non-transitory' only means that a storage medium is a tangible device, and does not include signals (e.g.: electromagnetic waves), and the term does not distinguish a case wherein data is stored in the storage medium semi-permanently and a case wherein data is stored temporarily. For example, 'a non-transitory storage medium' may include a buffer wherein data is temporarily stored.

Also, according to an embodiment, the method according to the various embodiments described in the disclosure may be provided while being included in a computer program product. A computer program product refers to a product, and it can be traded between a seller and a buyer. A computer program product can be distributed in the form of a storage medium that is readable by machines (e.g.: a compact disc read only memory (CD-ROM)), or may be distributed directly between two user devices (e.g.: smartphones), and distributed on-line (e.g.: download or upload) through an application store (e.g.: Play Store™). In the case of on-line distribution, at least a portion of a computer program product (e.g.: a downloadable app) may be stored in a storage medium such as the server of the manufacturer, the server of the application store, and the memory of the relay server at least temporarily, or may be generated temporarily.

What is claimed is:

1. A washing machine comprising:

a washing tub;

a detergent supply part to accommodate a liquid;

a fluid channel connecting the detergent supply part and the washing tub;

a motor controllable to supply the liquid accommodated in the detergent supply part into the washing tub through the fluid channel;

a water supply part controllable to supply water into the washing tub; and a processor configured to:

based on receiving a user command for cleaning the fluid channel, identify a type of the liquid accommodated in the detergent supply part, based on the identified type of the liquid being water, control the water supply part to supply water into the washing tub, after water is supplied into the washing tub, detect a level of water in the washing tub, and based on the detected level being greater than or equal to a predetermined value, control the motor so that the liquid accommodated in the detergent supply part is supplied into the washing tub through the fluid channel.

2. The washing machine of claim 1, wherein the detergent supply part includes:

a detergent container, and a fabric softener container, the motor includes:

a first motor controllable to supply a liquid accommodated in the detergent container into the washing tub through the fluid channel, and a second motor controllable to supply a liquid accommodated in the fabric softener container into the washing tub through the fluid channel, and the processor is further configured to:

based on identifying that the liquid accommodated in the detergent container is water, and the liquid accommodated in the fabric softener container is water, control the water supply part to supply water into the washing tub, and after water is supplied into the washing tub, detect a level of water in the washing tub, and based on the detected level being greater than or equal to the predetermined value, control the first motor so that the liquid accommodated in the detergent container is supplied into the washing tub through the fluid channel, and control the second motor so that the liquid accommodated in the fabric softener container is supplied into the washing tub through the fluid channel.

3. The washing machine of claim 2, wherein the processor is further configured to:

based on the detected level being greater than or equal to the predetermined value, control the first motor so that the liquid accommodated in the detergent container is supplied into the washing tub through the fluid channel during a predetermined first time, based on the predetermined first time passing, stop the first motor, and control the second motor so that the liquid accommodated in the fabric softener container is supplied into the washing tub through the fluid channel during a predetermined second time, and based on the predetermined second time passing, stop the second motor.

4. The washing machine of claim 3, wherein the processor is further configured to:

based on a predetermined third time passing after the second motor is stopped, repeatedly control during a predetermined fourth time:

the first motor so that the liquid accommodated in the detergent container is supplied into the washing tub through the fluid channel then stopped, and the second motor so that the liquid accommodated in the fabric softener container is supplied into the washing tub through the fluid channel then stopped.

5. The washing machine of claim 1, further comprising:

a drainage pump connected to the washing tub and controllable to discharge liquid accommodated in the washing tub to an outside of the washing machine, and wherein the processor is further configured to:

based on the liquid accommodated in the detergent supply part being supplied into the washing tub through the fluid channel, control the drainage pump to discharge the liquid accommodated in the washing tub to the outside of the washing machine.

6. The washing machine of claim 1, further comprising:

a door to open and close the washing tub, wherein the processor is further configured to:

based on receiving the user command, identify whether the door is closed, and based on identifying that the door is closed, identify the type of the liquid accommodated in the detergent supply part.

7. The washing machine of claim 1, wherein the processor is further configured to:

based on receiving the user command, identify whether the detergent supply part is coupled to the washing machine, and based on identifying that the detergent supply part is coupled, identify the type of the liquid accommodated in the detergent supply part.

8. A controlling method of a washing machine having a washing tub, a detergent supply part to accommodate a liquid, a fluid channel connecting the detergent supply part and the washing tub, a motor controllable to supply the liquid accommodated in the detergent supply part into the washing tub through the fluid channel, a water supply part controllable to supply water into the washing tub, and a processor, the controlling method comprising:

by the processor, based on receiving a user command for cleaning the fluid channel, identifying a type of the liquid accommodated in the detergent supply part;

based on the identified type of the liquid being water, controlling the water supply part to supply water into the washing tub;

detecting a level of water in the washing tub; and based on the detected level being greater than or equal to a predetermined value, controlling the motor so that the liquid accommodated in the detergent supply part is supplied into the washing tub through the fluid channel.

9. The controlling method of the washing machine of claim 8, the detergent supply part including: a detergent container, and a fabric softener container, and the motor including: a first motor controllable to supply a liquid accommodated in the detergent container into the washing tub through the fluid channel, and a second motor controllable to supply a liquid accommodated in the fabric softener container into the washing tub through the fluid channel, wherein:

the controlling the motor further includes:

controlling the first motor so that the liquid accommodated in the detergent container is supplied into the washing tub through the fluid channel, and then controlling the second motor so that the liquid accommodated in the fabric softener container is supplied into the washing tub through the fluid channel.

10. The controlling method of the washing machine of claim 9, wherein the controlling the motor further includes:

based on the detected level being greater than or equal to the predetermined value, controlling the first motor so that the liquid accommodated in the detergent container is supplied into the washing tub through the fluid channel during a predetermined first time;

based on the predetermined first time passing, stopping the first motor, and controlling the second motor so that the liquid accommodated in the fabric softener container is supplied into the washing tub through the fluid channel during a predetermined second time; and based on the predetermined second time passing, stopping the second motor.

11. The controlling method of the washing machine of claim 10, wherein the controlling the motor further includes:

based on a predetermined third time passing after stopping the second motor, repeatedly controlling during a predetermined fourth time:

the first motor so that the liquid accommodated in the detergent container is supplied into the washing tub through the fluid channel, then stopping the first motor, and the second motor so that the liquid accommodated in the fabric softener container is supplied into the washing tub through the fluid channel, then stopping the second motor.

12. The controlling method of the washing machine of claim 8, the washing machine further including a drainage pump connected to the washing tub and controllable to discharge liquid accommodated in the washing tub to the outside of the washing machine, the controlling method further comprising:

based on the liquid accommodated in the detergent supply part being supplied into the washing tub through the fluid channel, controlling the drainage pump to discharge the liquid accommodated in the washing tub to the outside of the washing machine.

13. The controlling method of the washing machine of claim 8, the washing machine further including a door to open and close the washing tub, the controlling method further comprising:

based on receiving the user command, identifying whether the door is closed, and wherein the identifying the type of the liquid accommodated in the detergent supply part further includes:

based on identifying that the door is closed, identifying the type of the liquid accommodated in the detergent supply part.

14. The controlling method of the washing machine of claim 8, further comprising:

based on receiving the user command, identifying whether the detergent supply part is coupled to the washing machine, and wherein the identifying the type of the liquid accommodated in the detergent supply part further includes:

based on identifying that the detergent supply part is coupled, identifying the type of the liquid accommodated in the detergent supply part.

* * * * *